United States Patent [19]

Haverbusch

[11] 4,173,368

[45] Nov. 6, 1979

[54] APPARATUS FOR FRICTIONALLY GRIPPING THE INTERIOR SURFACE OF A CONTAINER DURING HANDLING BY AN ARTICLE TRANSFERRING MEANS

[75] Inventor: Paul J. Haverbusch, Cincinnati, Ohio

[73] Assignee: The Lodge & Shipley Company, Cincinnati, Ohio

[21] Appl. No.: 901,637

[22] Filed: May 1, 1978

[51] Int. Cl.[2] ..... B66C 1/54

[52] U.S. Cl. ..... 294/88; 294/93; 294/100

[58] Field of Search ..... 294/86.15, 86.24, 86.25, 294/87 R, 88, 90, 93-97, 99 R, 100, 115, 116; 214/309

[56] References Cited

U.S. PATENT DOCUMENTS

| | | | |
|---|---|---|---|
| 2,800,355 | 7/1957 | Vinner et al. | 294/88 |
| 2,863,579 | 12/1958 | Meyer | 294/87 R X |
| 3,052,494 | 9/1962 | Williamson | 294/93 |
| 3,075,800 | 1/1963 | Rowekamp | 294/88 |
| 3,314,714 | 4/1967 | Brubaker | 294/93 |

FOREIGN PATENT DOCUMENTS

| | | | |
|---|---|---|---|
| 1048820 | 1/1959 | Fed. Rep. of Germany | 294/93 |
| 2328617 | 5/1974 | Fed. Rep. of Germany | 294/93 |

*Primary Examiner*—Johnny D. Cherry

*Attorney, Agent, or Firm*—Wood, Herron & Evans

[57] ABSTRACT

An apparatus employed with elements for transferring articles, such as open mouth containers like glass jars, is actuable to frictionally grip the interior surface of a container during handling. The apparatus includes a cup which forms a cylinder. A post member is mounted in the cylinder and depends downwardly to a point outside the interior of the cup. A piston is slidably mounted within the cup. A flexible element, such as four circumferentially spaced straps, is secured at one end to the piston and at the other end to the post member at a point outside the cup. A duct connects the cup to a controllable source of air pressure. An urging element, such as a coil spring disposed between the post means and the piston, normally urges the piston to the top of the cup. Upon application of air pressure to the cup, the piston is driven downwardly, and the straps flex radially outwardly so as to frictionally grip the interior surface of a container. When air pressure is removed, the spring drives the piston upwardly, and the straps draw inwardly to release the container. Preferably, the post member includes a threaded sleeve mounted to the cup and an adjustment screw which threads into and out of the sleeve to set the initial flexure of the straps to accommodate containers with different mouth sizes.

6 Claims, 5 Drawing Figures

APPARATUS FOR FRICTIONALLY GRIPPING THE INTERIOR SURFACE OF A CONTAINER DURING HANDLING BY AN ARTICLE TRANSFERRING MEANS

BACKGROUND OF THE INVENTION

This invention relates to article transferring means which are employed in the handling of open mouth containers, such as glass jars, during the loading and unloading of boxes. More particularly, the present invention is directed to an element of such article transferring means which grips a container during handling.

The prior art discloses various means for transferring containers, and each includes a type of apparatus for gripping a container during handling. While one type of apparatus grips the exterior surface of a container, such as the apparatus shown in U.S. Pat. No. 3,086,805, such a form of engagement cannot be employed in handling wide mouth containers. This is because the size of the spaces in boxes closely approximates the size of the mouths of such containers, and, consequently, the physical dimensions of external gripping apparatus preclude proper alignment of containers required for loading and unloading.

In order to handle wide mouth containers, the prior art discloses another type of apparatus which grips the interior surface of a container. One such apparatus is shown in U.S. Pat. No. 2,818,987 and includes a rubber cup supported by a rod together with a plate which is slid downwardly on the rods to compress the rubber cup such that the walls of the rubber cup bulge outwardly thereby frictionally gripping the interior surface of a container. Because the rod is rigid, however, there is no sidewise flexibility, and the gripping apparatus occasionally hangs up on the lip of a misaligned container and crushes it or knocks it over. Furthermore, the structure that is disclosed in this patent is mechanically complex since there are many moving parts for actuating the gripping apparatus. Additionally, there is no means for adjusting the gripping apparatus for handling containers with different mouth sizes.

U.S. Pat. No. 3,075,800 discloses an apparatus for gripping the interior surface of a container which includes a piston and cylinder, the cylinder being connected to an air manifold through a rubber hose which mounts the gripping apparatus to the container transferring means. The piston has camming surfaces contacting gripper fingers. When air is introduced into the cylinder, the piston cams the gripper fingers apart to frictionally grip the interior surface of a container, and upon removal of the air a spring and a rubber diaphragm return the piston to the top of the cylinder and reclose the gripper fingers. Since the gripping apparatus in this patent is mounted by the rubber hose, the rubber hose flexes sidewise to eliminate to some extent hang up on the lip of a misaligned container. Nevertheless, the rigid gripper fingers on occasion hang up on the lip of a misaligned container. Additionally, there is no means by which the gripping apparatus can be adjusted for handling containers of different mouth sizes.

SUMMARY OF THE INVENTION

Accordingly, one objective of this invention is to provide an improved gripping apparatus of the type which frictionally grips the interior surface of a container during handling that does not have a tendency to hang up on the lip of a misaligned container.

A further objective of this invention is to provide gripping apparatus of the type indicated which is adjustable for use with containers having different mouth sizes, such as containers with a range of mouth diameters from $2\frac{1}{8}$ to $3\frac{3}{4}$ inches.

In accordance with a preferred embodiment of the present invention, gripping apparatus is provided which includes a cup mounted to a means for transferring containers. The cup has a hollow interior forming a cylinder with an open bottom. The top of the cup has a duct which connects to a controllable source of air pressure. A post means is mounted to the top of the cup and extends downwardly through the hollow interior and the open bottom of the cylinder to a point outside the cup. A piston is slidably mounted in the cup and preferably is annular such that it rides along the post means. A flexible means, such as four circumferentially spaced straps, is secured at one end to the piston and at the other end to the post means at a point outside the cup. An urging means, such as a coil spring disposed between the post means and the piston, normally urges the piston to the top of the cup.

Upon application of air pressure, the piston is driven downwardly in the cup along the post means so as to flex the straps radially outwardly into frictional contact with the interior surface of a container into which the gripping apparatus is partially inserted. Upon removal of air pressure, the coil spring which is depressed on downward movement of the piston returns the piston to the top of the cup so as to draw the straps radially inwardly to release the container.

Preferably, the post means includes a stem and an adjustment screw which threads into the stem. The adjustment screw can be threaded into and out of the stem varying amounts to initially flex the straps a predetermined amount so that the straps clear the lip of a container but so that upon actuation of the piston the straps are radially flexed outwardly the proper amount for frictionally gripping the container.

Advantageously, the structure of the gripping apparatus eliminates any tendency to hang up on misaligned containers. Also, containers with a range of mouth sizes can be accommodated by setting the adjustment screw.

BRIEF DESCRIPTION OF THE DRAWING

The present invention will be better understood and its concomitant advantages will be better appreciated by those of skill in the art through a consideration of the preferred embodiment shown in the drawing and the description which follows. In the drawing.

DESCRIPTION

Figure 1:
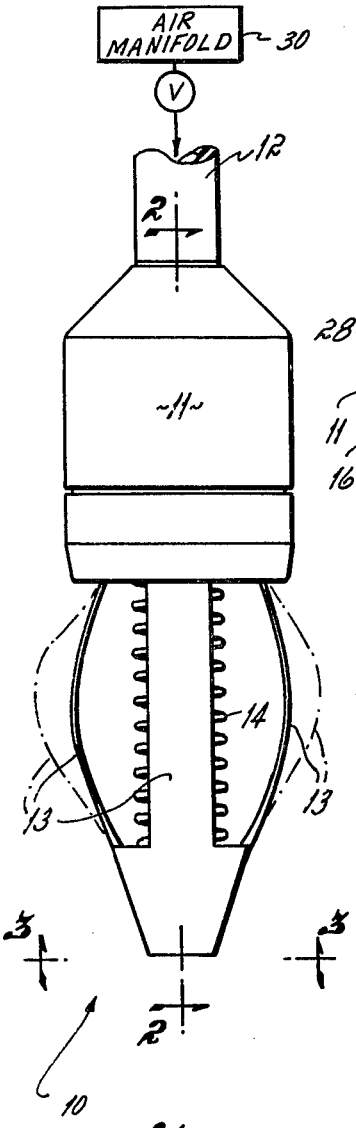
FIG. 1 is a view in elevation of a preferred embodiment of an apparatus in accordance with the present invention for frictionally gripping the interior surface of a container.
Figure 3:
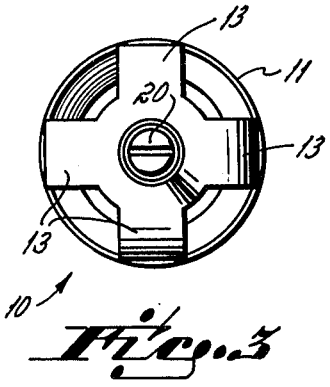
FIG. 3 is a view taken along line 3—3 of FIG. 1.

A preferred embodiment of a gripping apparatus in accordance with the present invention is shown in elevation in FIG. 1. The gripping apparatus 10 includes a cup 11 which is mounted, as by a rubber hose 12, to an air manifold 30 included in the container transferring means. The arrangement for mounting the cup 11 to the container transferring means is similar to that disclosed in above-mentioned U.S. Pat. No. 3,075,800.

Extending out of the cup 11 is a flexible means, such as four circumferentially spaced straps 13 which may consist of nylon. An urging means, such as a coil spring 14, causes the straps 13 to assume the solid line position shown in FIG. 1 as will become clear later from a consideration of FIGS. 4 and 5. This is the position of the straps 13 for entering or leaving a container. When the gripping apparatus in FIG. 1 is actuated, however, the straps 13 flex radially outwardly to the phantom line position shown in FIG. 1 as will become clear later from a consideration of FIGS. 4 and 5. This is the position of the straps 13 for frictionally gripping the interior surface of a container.

Figure 2:
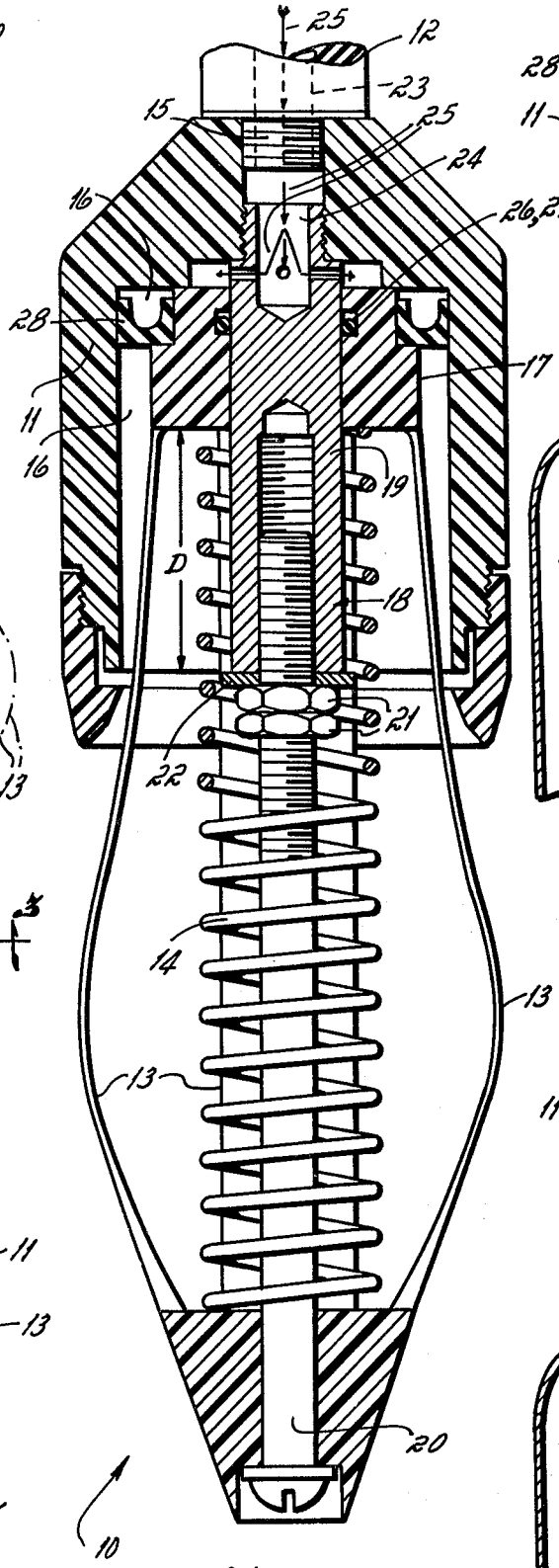
FIG. 2 is a cross-sectional view taken along line 2—2 of FIG. 1.

As shown in FIG. 2, the rubber hose 12 includes a brass bushing 15 preferably molded into the hose. The cup 11 is threaded onto the brass bushing 15 to mount the cup 11 to the hose 12 which is in turn secured to the air manifold included in the container transferring apparatus. The cup 11 has a hollow interior 16 which forms a cylinder for a piston 17.

A post means 18 is mounted to the cup 11. The post means 18 is preferably mounted in the center of the hollow interior 16 so that the axis of the post means 18 coincides with the axis of the cup 11.

As shown in FIG. 2, the post means 18 preferably includes a stem 19 and an adjustment screw 20. The adjustment screw 20 is adjustably threaded into and out of the stem 19 a predetermined amount to accommodate containers of different mouth sizes as will be described in more detail later. Lock nuts 21 are provided to secure the adjustment screw 20 in a preset position. A washer 22 having a diameter greater than the diameter of the stem 19 is captured between the stem 19 and the lock nuts 21 to limit downward travel of the piston 17 as will be described in more detail later.

The hose 12 has an air passage 23 connected to a controllable source of air pressure supplied by the air manifold included in the article transferring apparatus. The air passage 23 communicates with a duct 24 in the cup 11 which in turn communicates with the hollow interior 16 of the cup 11 through a passage or passages in the stem 19 as indicated by the air flow path arrow 25 in FIG. 2.

The piston 17 is preferably annular and has an interior surface slidably mounted on the stem 19 so as to ride along the stem. The piston 17 has a circumferential groove 26 in which is disposed an O-ring 27 to provide an air-tight seal between the piston 17 and the stem 19. The outer surface of the piston 17 is relieved to accommodate a cup-shaped gasket 28 to provide an air-tight seal between the piston 17 and the cup 11 upon application of air pressure through the air flow path 25.

As shown in FIG. 2, the straps 13 are mounted between the lower end of the adjustment screw 20 and the piston 17. The spring 14 urges the piston 17 to the top of the hollow interior 16 of the cup 11. This is because the spring 14 exerts a force between the lower end of the adjustment screw 20, which forms part of the post means 18 fixedly mounted with respect to the cup 11, and the piston 17, which is slidably mounted with respect to cup 11.

As was pointed out above, the gripping apparatus is adjustable for handling containers having different mouth sizes. As shown in FIG. 2, the piston 17 has a fixed downward travel within the cup 11 upon application of air pressure. Specifically, the piston 17 travels from the position shown in FIG. 2 downwardly until the lower surface of the piston 17 contacts the washer 22 as indicated by the distance D. Consequently, movement through the distance D causes only a certain amount of flexure of the straps 13 radially outwardly from the post means 18.

In order to accommodate containers with different mouth sizes, such as in a range from 2⅛ to 3¾ inches, the lock nuts 21 are loosened, and the adjustment screw 20 is rotated into or out of the stem 19 to set a predetermined initial outward flexure of the straps 13 dependent on the size of the mouth of the container to allow the gripping apparatus 10 to be partially lowered into or raised out of a container without contact. However, upon application of air pressure, the piston 17 travels downwardly through the distance D, and the straps 13 flex radially outwardly an additional amount so as to frictionally grip the inner surface of the container.

The lower end of the gripping apparatus 10 is preferably cone-shaped as shown in FIGS. 1 and 2, and the straps 13 are symmetrically located around the axis of the post means 18. If a container is slightly misaligned, the conical configuration of the gripping apparatus 10 tends not to hang up on the lip of a misaligned container upon partial insertion of the gripping apparatus 10. Furthermore, the straps 13 are flexible and thus tend to orient a misaligned container.

Figure 4:
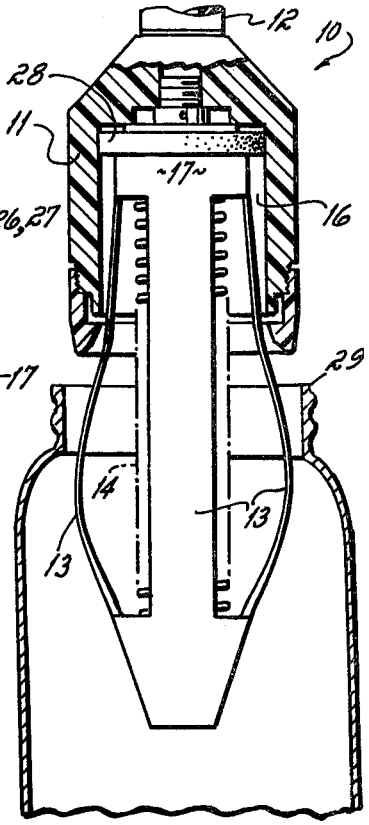
FIG. 4 is a diagrammatic view illustrating the apparatus in FIG. 1 relative to a container when the apparatus is not frictionally gripping the container, such as during insertion or release of the container by a container transferring means.
Figure 5:
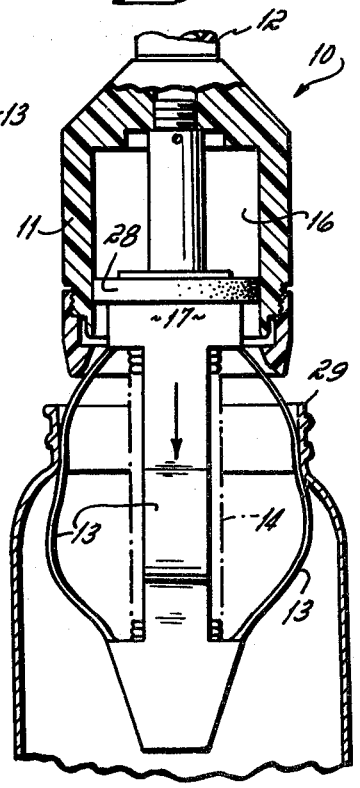
FIG. 5 is a view illustrating the apparatus in FIG. 1 frictionally gripping the interior surface of a container, such as during handling by a container transferring means.

With reference now to FIGS. 4 and 5, the adjustment screw 20 is first set to initially outwardly flex the straps 13 a predetermined amount so that upon insertion and removal of the gripping apparatus 10 the straps 13 just clear the lip 29. Normally, the spring 14 urges the piston 17 to the top of the cup 11 as shown in FIG. 4 to assure that the lower portion of the gripping apparatus 10 can be inserted into or removed from the container after the adjustment screw 20 is initially set without fear of the straps 13 binding in the mouth of the container.

Upon application of air pressure, the piston 17 travels downwardly in the cup 11 as shown in FIG. 5 to flex the straps 13 radially outwardly an additional amount so that the straps frictionally grip the inner surface of the container. Consequently, the container can be transferred to any desired location. Subsequently, upon removal of air pressure, the piston 17 returns to the position shown in FIG. 4 due to the action of the spring 14 so that the container is released.

Advantageously, the gripping apparatus of the present invention can be adjusted to handle containers with a wide range of mouth sizes as well as flare mouth containers. Furthermore, the gripping apparatus of the present invention avoids hanging up on a container during insertion or removal of the gripping portion so as to eliminate production downtime associated with removal by an operator of hung-up and broken or knocked-over containers.

While the flexible means in accordance with the preferred embodiment of the present invention is shown to comprise four circumferentially spaced straps, any desired number of straps or even a resilient bladder may comprise the flexible means. When the flexible means comprise straps, the straps may be covered by tubular bands, such as Tygon tubing, or coated with a soft elastomeric material in order to enhance frictional gripping.

Furthermore, although the post means in accordance with the preferred embodiment of the present invention is shown to include a stem centrally mounted in the cup, the stem may be replaced by a bracket mounted to the outside of the cup having fingers extending radially inwardly below the cup between the straps for holding a centrally located threaded sleeve into which the adjustment screw threads, the sleeve also limiting downward movement of a standard, rather than an annular, piston. Other modifications may also become apparent to those of skill in the art without departing from the scope of the present invention. Consequently, applicant intends to be bound only by the scope of the appended claims.

I claim:

1. An apparatus employed with means for transferring open mouth containers, said apparatus comprising:

a cup mounted to said transferring means, said cup having a top end, an open bottom end and a hollow interior, said top end having a duct for connecting said hollow interior to a controllable source of air pressure;

post means having an upper end centrally mounted within the hollow interior of said cup to the top end of said cup and a lower end extending exteriorly through the open bottom end of said cup, the axis of said post means being coincidental with the axis of said cup;

an annular piston slidably mounted on said post means for slidable travel along said post means within said cup;

flexible means secured at an upper end to said piston and secured at a lower end to said post means exteriorly of said cup; and means disposed between said post means and said piston for urging said piston against the top end of said cup so as to normally establish a predetermined distance between the lower end of said post means and said piston;

whereby upon application of air pressure to overcome said urging means said piston is driven along said post means so as to decrease the distance between the lower end of said post means and said piston thereby expanding said flexible means radially outwardly with respect to the axis of said post means so as to frictionally grip the interior surface of an open mouth container into which the lower end of said post means is inserted.

2. An apparatus employed with means for transferring open mouth containers, said apparatus comprising:

a cup mounted to said transferring means, said cup having a hollow interior to provide a cylinder which is open at the bottom;

a duct in said cup to connect said hollow interior to a controllable source of air pressure;

post means mounted to said cup and extending exteriorly beneath the open bottom of said cup;

a piston in said cup adapted to travel downwardly upon the application of air pressure through said duct;

flexible means having a first portion secured to said piston, a second portion secured to said post means exteriorly of said cup and a central portion lying between said first and second portions; and means for urging said piston toward an elevated position within said cup;

whereby upon application of air pressure to overcome said urging means said piston travels downwardly in said cup thereby expanding the central portion of said flexible means radially outwardly from said post means so as to frictionally grip the interior surface of an open mouth container which surrounds said post means exterior of said cup.

3. In an apparatus for transferring open mouth containers, said transferring apparatus being adapted for movement to a position withdrawn from a container, movement to a position overlying a container, movement to a position wherein at least an actuable means is partially lowered into the interior of a container for selective frictional gripping of the interior surface of a container and movement to a position of transfer for selective release of a container, the improvement in said actuable means comprising:

a cup having a hollow interior to provide a cylinder which is open at the bottom;

a duct in said cup communicating with a controllable source of air pressure;

a piston in said cup adapted to travel downwardly upon the application of air pressure through said duct;

post means mounted in a fixed position with respect to said cup, at least a section of said post means lying outside said hollow interior;

flexible means having a first portion secured to said piston and a second portion secured to the section of said post means lying outside said hollow interior; and means disposed between said post means and said piston for urging said piston toward an elevated position within said cup;

whereby upon application of air pressure to overcome said urging means said piston travels downwardly in said cylinder thereby expanding said flexible means radially outwardly for frictional gripping of the interior surface of a container and whereby upon removal of air pressure said urging means moves said piston upwardly in said cylinder thereby drawing said flexible means radially inwardly for releasing a container.

4. The apparatus of claim 1, 2 or 3 wherein said post means includes a stem mounted to said cup and an adjustment screw threadable into and out of said stem for setting a predetermined initial outward flexure of said flexible means, whereby said apparatus is adjustable for frictionally gripping containers having a range of mouth sizes.

5. The apparatus of claim 1, 2 or 3 wherein said flexible means comprises four circumferentially spaced straps.

6. A gripping apparatus comprising:

a downwardly opening cup;

a post fixed to the center of said cup and depending therefrom, said post having a lower end beneath said cup;

a piston in said cup;

flexible means connected between the lower end of said post and said piston; and means for lowering said piston to expand said flexible means into a container gripping orientation.

* * * * *